United States Patent [19]

Yonezawa

[11] 4,223,470

[45] Sep. 23, 1980

[54] SAVINGS BOX TOY WITH LOCKING LID FOR SAFETY

[75] Inventor: Hiroichi Yonezawa, Matsudo, Japan

[73] Assignee: Kabushiki Kaisha Yoneya Gangu, Tokyo, Japan

[21] Appl. No.: 918,509

[22] Filed: Jun. 23, 1978

[30] Foreign Application Priority Data

Dec. 14, 1977 [JP] Japan ..... 52/167582[U]

[51] Int. Cl.[3] ..... A63H 33/00

[52] U.S. Cl. ..... 46/5; 46/4

[58] Field of Search ..... 46/4, 5, 2, 3

[56] References Cited

U.S. PATENT DOCUMENTS

| | | | |
|---|---|---|---|
| 487,773 | 12/1892 | Reynolds | 46/4 |
| 2,606,394 | 8/1952 | Janiak | 46/4 |
| 2,635,383 | 4/1953 | Singer | 46/4 |
| 3,243,914 | 4/1966 | Poynter | 46/3 |
| 3,475,848 | 11/1969 | Gruber | 46/5 |
| 3,512,298 | 5/1970 | Poynter | 46/3 |

*Primary Examiner*—Louis G. Mancene
*Assistant Examiner*—Michael J. Foycik, Jr.
*Attorney, Agent, or Firm*—L. Lawton Rogers, III

[57] ABSTRACT

A savings toy box in which a coin may be placed in a predetermined position to be grasped by a hidden mechanism and pulled into the box.

1 Claim, 4 Drawing Figures

SAVINGS BOX TOY WITH LOCKING LID FOR SAFETY

BACKGROUND OF THE INVENTION

This device relates to a savings box toy.

Recently, there has been proposed a savings toy which is not of a mere constitution wherein a coin is thrown in manually from a throwing port, but in which a coin can be thrown in by the action of a member mounted in the body of the savings box. Such savings box toys have been favorably received, but have in some cases been unsafe for infants.

It is accordingly the object of the present device to provide a novel savings box toy of a new structure in which the coin throwing action is sure and with which infants can play with much interest. This and many other objects and advantages will be readily apparent from the claim and from the following detailed description of a preferred embodiment.

DETAILED DESCRIPTION OF THE DRAWINGS

The acompanying drawings show a working embodiment of the present device, in which.

DETAILED DESCRIPTION

Figure 1:
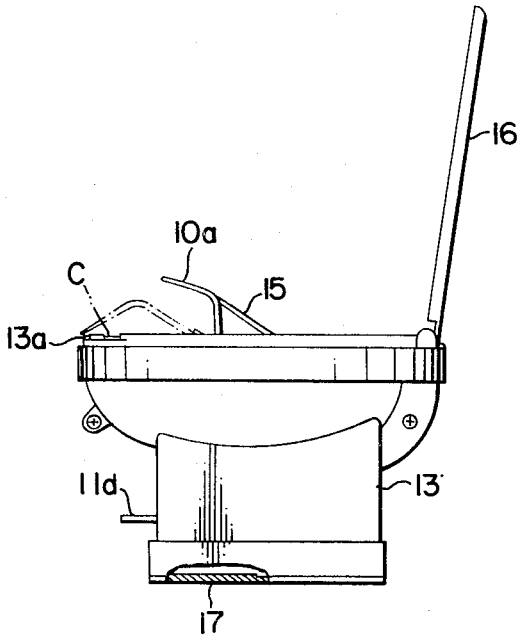
FIG. 1 is a side view with an opened outer cover.

A spiral spring 2 is anchored at one end to the frame 1 and the other end rolled attached to a shaft 3. A first imtermediate pinion shaft 4 having a first intermediate gear 4*a* meshes with a gear 3*a* mounted on the shaft 3. An output shaft 5 is provided with a pinion meshing with the intermediate gear 4*a*, which output shaft 5 is formed so that the end thereof projects from a side of the frame 1. A second intermediate pinion shaft 6 is provided and has an intermediate gear 6*a* meshing with a gear 5*a* of the output shaft 5. A third pinion shaft 7 with a third intermediate gear 7*a* meshes with the intermediate gear 6*a*. A stopper shaft 8 on which is mounted a stopper cam 8*a* is formed of a pinion meshing with the intermediate gear 7*a*. These shafts are mounted in the frame 1 successively from right to left in FIG. 3.

A crank 9 is attached to a lug portion of the output shaft 5 in the frame 1, which crank 9 is provided at the upper end thereof with an engaging lug 9*a* and at the lower end thereof with a connecting shaft 9*b*. An inverted L-shaped operating rod 10 is provided whose lower end portion is pivoted to the crank 9 by means of the connecting shaft 9*b*. In this embodiment, a transverse member 10*a* of the operating rod 10 is formed in the shape of a human hand when viewed from above, and the operating rod 10 is disposed so that the transverse member 10*a* faces the left in FIG. 3. An operating lever 11 whose side is shaped in the form of an inverted L and whose rear end is pivotally attached to 11*c* to the frame 1 while the spring force of a spring 11*b* fixed to the frame 1 is exerted, so that in the normal state a nose portion 11*a* of the operating lever 11 engages the lug portion 9*a* of the crank 9. A pressure portion 11*d* of the operating lever 11 projects to the side of the frame 1 (the left side in FIG. 3).

A stopper rod 12 is disposed on the side of the stopper shaft 8 (the right side in FIG. 3), the stopped rod being composed of a longitudinal member the middle portion of which is pivoted at 12*a* to the frame 1. A spring 12*b* adapted to stretch the stopped rod 12 toward the outside of the frame 1 is mounted between a portion above the pivoted point 12*a* of the stopper rod 12 and the frame 1. An engaging piece 12*c* is formed at the lower end of the stopper rod 12, which in normal state is adapted to engage the stopped cam 8*a*. A knob 3*a* is provided for winding the spiral spring, which knob is attached to the shaft 3.

In the embodiment described in normal state, the nose portion 11*a* of the operating lever 11 engages the lug 9*a* of the crank 9, while the engaging piece 12*c* of the stopper rod 12 is in engagement with the stopper cam 8*a*, so that the operation of the gear interlocking mechanism by the force stored in the spiral spring 2 is blocked. If the pressure portion 11*d* of the operating lever 11 is pushed down and the upper portion of the stopper rod 12 is pushed counterclockwise, both the above engaging portions become disengaged and the gear interlocking mechanism operates, whereby the crank is allowed to rotate clockwise. Even if only one of the above two engaging portions becomes disengaged, the gear interlocking mechanism cannot operate.

Figure 2:
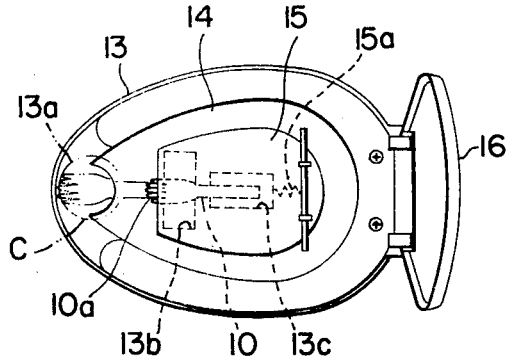
FIG. 2 is a top plan view of the embodiment of FIG. 1.

The vessel body 13 may take the shape of the so-called Western style toilet stool, in the upper face of which is formed a hollow portion 14. A coin placing portion 13*a* is formed at the front end of the vessel body 13 (the left side in FIGS. 1 and 2). Moreover, in the hollow portion 14 are longitudinally formed a coin throwing port 13*b* and a through hole 13*c* through which the upper portion of the operating rod 10 is projected for free movement.

An inner cover 15 covers the coin throwing port 13*b* and the through hole 13*c*, the rear end side (the right side in the drawing) of said inner cover being attached for opening and closing to the hollow portion 14 through a spring 15*a* so that the spring force acts on the closing side. An outer cover 16 is provided with its rear end side pivotally attached for opening and closing to the rear end side of the upper face of the vessel body 13. The outer cover 16 is provided at the rear end thereof with an operating lug 16*a* which actuates the stopper rod 12 in connection with the upper end of the same rod in said operating body. The foregoing structure 13 through 16 forms a savings box vessel to accommodate the above-mentioned operating body. A recovery cover 17 is provided to take out the coins in the vessel.

The operating body is mounted in the vessel and thus an embodiment of the savings box toy of the present device is constituted. In this case, the pressure portion 11*d* of the operating level 11 is projected outside the vessel body 13 through a hole (not shown) formed in the same body, the transverse member 10*a* of the operating rod 10 is projected from the through hold 13*c* of the hollow portion 14 present on the lower face side of the inner cover 15, and the upper end of the stopper rod 12 is brought into engagement with the operating lug 16*a* of the outer cover 16. In this way, the operating body is positioned and fixed within the vessel body.

The toy of the present device constituted as above operates as follows.

Figure 3:
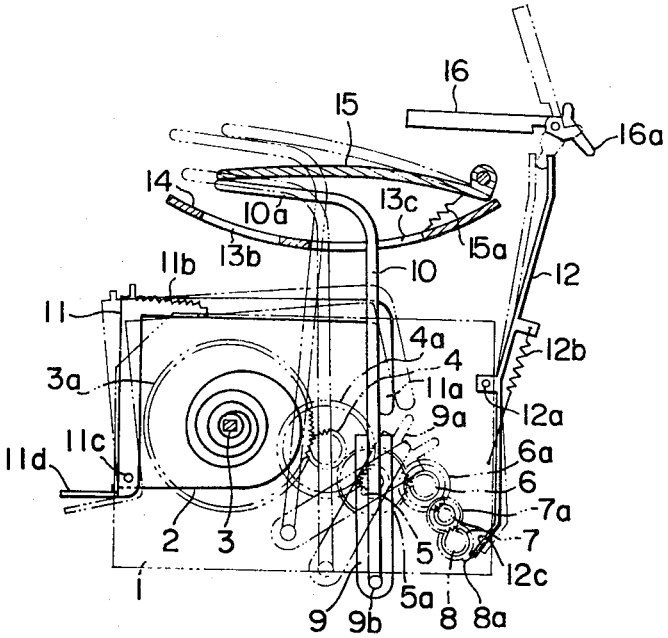
FIG. 3 is a right side view showing the operational structure.
Figure 4:
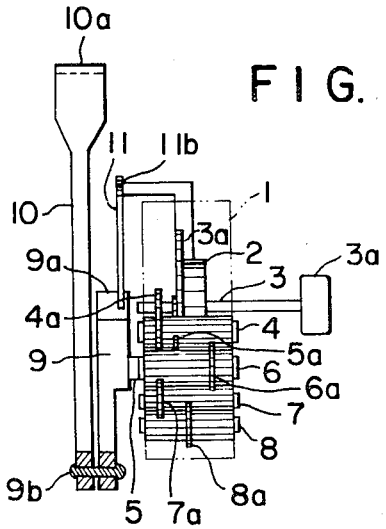
FIG. 4 is a right side view of the embodiment of FIG. 3 with portions omitted.

As indicated with continuous lines in FIG. 3, the knob 3*a* is turned clockwise to store a winding force in the spiral spring 2 under a closed condition of the outer cover 16, the relation of the crank 9 to the operating rod 10 connected thereto and the operating lever 11 which locks the crank 9, and the relation of the stopper cam 8 to the stopper rod 12 in engagement therewith and the operating lug 16*a* of the outer cover 16 which causes the stopper rod 12 to operate to the release side. When the outer cover 16 is opened, the operating lug 16*a* causes the upper portion of the stopper rod 12 to pivot slightly counterclockwise, which causes the engaging piece 12*c* to move out of engagement with the stopper cam 8*a* and thus causes the coin placing portion 13*a* to appear outside. Therefore, if a coin C is put on the coin placing portion 13*a* and the pressure portion of the operating lever 11 is pushed, the nose portion 11*a* of the operating lever 11 goes away from the lug portion 9*a* of the crank 9, the gear interlocking mechanism begins to operate to turn the crank 9 clockwise and the operating rod 10 connected to the crank 9 operates. The operating rod 10 is lightly forced down by the inner cover 15 which is mounted through a spring from the rear side and above the operating rod and at the same time it is within the through hole 13*c*. In an upward movement of the operating rod 10 along with the rotation of the crank 9, and before the connecting shaft 9*b* of the crank 9 reaches the top dead center, the operating rod 10 forces open the inner cover 15 against the compressive force of the spring and the inner cover at the same time is pushed forward while pivoting by the compressive force of the said spring. In the top dead center of the crank 9, the nose portion of the transverse member 10*a* of the operating rod 10 reaches the other side of the coin C and hooks itself to the front end of the coin C (the left side in FIG. 1). By the further rotation toward the bottom dead center of the crank 9, the operating rod 10 returns to the original position while being forced down by the inner cover 15 obliquely from above. In other words, the transverse member 10*a* of the operating rod 10 is drawn out while describing a circular arc, covers the coin C from the upper side of the latter and then is drawn in such a manner that the coin C is raked in the throwing port 13*b*.

When the crank 9 has reached the bottom dead center and the operating rod 10 returned to the original position, the nose portion 11*a* of the operating lever 11, which has self-returned by the action of the spring 11*b*, is brought into engagement with the lug portion 9*a* of the crank 9, so that the rotation of the crank 9 is blocked. Therefore, to again operate the operating rod 10, the operating lever 11 must be pushed once more.

As long as the outer cover 16 is closed, even if the operating lever 11 is pushed, the operating rod 10 never operates. Because, with the outer cover 16 in a closed state, the operating lug 16*a* of the outer cover 16 goes away from the upper end of the stopper rod 12 and the engaging piece 12*c* of the stopper rod 12 engages the stopper cam 8*c*, so that the gear interlocking mechanism is maintained in an inoperative condition.

The present device as expalined above has the following advantages as compared with convention savings box toys. In the throwing in of a coin, a movement not depending on the hand was added, as a result of which infants can play with much interest. The behavior of the operating rod adapted to throw a coin into the vessel is controlled by two members, i.e., operating lever and stopper rod. In addition, the operation of the stopper rod is controlled by opening/closing of the outer cover, so that in a closed condition of the outer cover there is no fear of operation of the operating rod. Moreover, the mode of operation of the operating rod is controlled by the compressive force of the inner cover mounted through a spring and its through hole, so that a coin can be introduced positively in the throwing port. Since in the normal state the inner cover covers the coin throwing port and the operating rod, it is possible to have users feel unexpectedness for the operation of the operating rod and have them take interest therein. Thus, the present device is effective as a savings box toy.

As is apparent from the foregoing, many modifications may be made to the example disclosed without departing from the scope of the invention as defined by the following claims.

What is claimed is:

1. A savings box toy comprising an operating body and a vessel body, said operating body including:

a frame, a gear interlocking mechanism having a spiral spring as a motive power, a gear shaft in said gear interlocking mechanism, said gear shaft serving as an output shaft and being projected exteriorly of said frame, a crank attached to said gear shaft, an inverted L-shaped operating rod the lower end of which is pivotally attached to said crank, an operating lever mounted pivotally and through a spring on one side of said frame and having a nose portion which is adapted to block and release the motion of said crank, and a stopper rod disposed longitudinally of said frame and mounted pivotally and through a spring on the other side of said frame, said stopper rod engaging a stopper cam mounted on a stopper shaft which consists of another gear shaft in said gear interlocking mechanism; and a vessel body of a suitable shape, said vessel body including:

a coin placing portion, a coin throwing port, a through hole through which the upper part of said operating rod is projected to allow the latter to move freely, said coin placing portion, coin throwing port and through hole being formed on one side of the upper face of said vessel body, an inner cover mounted pivotally and through a spring on the other side of said upper face, said inner cover covering said coin throwing port and said through hole, and an outer cover pivotally mounted for opening and closing on the upper face of said inner cover, said outer cover having a rear end portion on which is formed a lug associated with the upper end of said stopper rod, the nose side of said operating rod being projected from the through hole in the lower face of said inner cover toward said coin placing portion, the nose portion of said stopper rod being associated with said lug formed at the rear end of said outer cover and the rear end side of said operating lever being projected and fixed to the exterior of the vessel body, whereby upon opening of said outer cover, the lug thereof pushes the nose portion of said stopper rod, thus causing the lower end portion of said stopper rod to move out of engagement with said stopper cam, so that if the operating lever is pushed in this state, the crank which has been blocked in its rotation by engagement with the nose portion of said operating lever is released and rotates, resulting in that the nose portion of said operating rod is pivoted to said crank, forces said inner cover up and open, reciprocates on said coin placing portion and throws the coin thereon into said coin throwing port.

* * * * *